US011686555B2

(12) United States Patent
Tepper

(10) Patent No.: US 11,686,555 B2
(45) Date of Patent: Jun. 27, 2023

(54) MULTI-CURVE STEEL BODY ARMOR AND METHOD OF MANUFACTURING SAME

(71) Applicant: TK ARMOR SYSTEMS, L.L.C., Tucson, AZ (US)

(72) Inventor: Jeremy Tepper, Vail, AZ (US)

(73) Assignee: TK ARMOR SYSTEMS, L.L.C., Tucson, AZ (US)

( * ) Notice: Subject to any disclaimer, the term of this patent is extended or adjusted under 35 U.S.C. 154(b) by 108 days.

(21) Appl. No.: 17/467,948

(22) Filed: Sep. 7, 2021

(65) Prior Publication Data

US 2021/0404772 A1 Dec. 30, 2021

Related U.S. Application Data

(62) Division of application No. 16/025,522, filed on Jul. 2, 2018, now Pat. No. 11,112,219, which is a division of application No. 15/013,906, filed on Feb. 2, 2016, now Pat. No. 10,030,942.

(60) Provisional application No. 62/110,911, filed on Feb. 2, 2015.

(51) Int. Cl.

| | |
|---|---|
| ***F41H 5/04*** | (2006.01) |
| ***B21D 5/02*** | (2006.01) |
| ***F41H 1/02*** | (2006.01) |
| ***F41H 5/02*** | (2006.01) |

(52) U.S. Cl.

CPC ..... *F41H 5/045* (2013.01); *B21D 5/02* (2013.01); *F41H 1/02* (2013.01); *F41H 5/02* (2013.01); *F41H 5/023* (2013.01)

(58) Field of Classification Search

CPC . F41H 5/045; F41H 5/02; F41H 5/023; F41H 1/02; B21D 5/02; B21D 11/20

USPC ..... 89/36.02; 72/379.2

See application file for complete search history.

(56) References Cited

U.S. PATENT DOCUMENTS 2,102,963 A * 12/1937 Miller ..... B23K 20/04 72/46
2,324,808 A * 7/1943 Abbott ..... F41H 5/045 148/211
3,395,067 A * 7/1968 Lane, Jr. ..... F41H 5/0435 428/164
3,846,105 A * 11/1974 Petrella et al. ..... B29C 53/04 33/1 BB
3,858,241 A * 1/1975 Durand ..... F41H 1/02 2/2.5
4,004,493 A * 1/1977 Costanza ..... F41H 1/02 89/922
5,515,541 A * 5/1996 Sacks ..... F41H 5/0492 2/2.5
5,738,925 A * 4/1998 Chaput ..... B32B 3/18 428/101

(Continued)

*Primary Examiner* — Samir Abdosh
(74) *Attorney, Agent, or Firm* — Quarles & Brady LLP

(57) ABSTRACT

A steel armor plate and method of manufacturing is described. The armor plate has three curves, a first curve about an axis that parallels the length of the armor plate, and two additional curves about axes that parallel the width of the armor plate. A die for manufacturing said plate is described, the die being formed of a stack of metal plates, each plate having a curve that substantially matches the first curve, the stack of plates being arranged in a step-down-then-step-up fashion to form a concavity that approximates one of the two additional curves.

19 Claims, 7 Drawing Sheets

(56) References Cited

U.S. PATENT DOCUMENTS

| | | | | | |
|---|---|---|---|---|---|
| 5,996,115 | A * | 12/1999 | Mazelsky | F41H 1/02 | 2/2.5 |
| 6,021,703 | A * | 2/2000 | Geiss | F41H 5/007 | 89/36.02 |
| 6,405,630 | B1 * | 6/2002 | Gonzalez | F41H 7/035 | 89/36.01 |
| 6,609,452 | B1 * | 8/2003 | McCormick | F41H 5/0414 | 89/36.01 |
| 7,540,228 | B1 * | 6/2009 | Cronin | F41H 5/0421 | 2/2.5 |
| 8,397,619 | B2 * | 3/2013 | Genihovich | F41H 5/0485 | 89/36.02 |
| 9,021,612 | B1 * | 5/2015 | O'Neal | F41H 1/02 | 2/2.5 |
| 9,046,324 | B2 * | 6/2015 | Bergman | F41H 5/0414 | |
| 9,127,334 | B2 * | 9/2015 | Pandey | C22F 1/043 | |
| 9,671,199 | B1 * | 6/2017 | Miller | F41H 5/045 | |
| 2006/0213361 | A1 * | 9/2006 | Muller | F41H 5/02 | 89/929 |
| 2008/0223204 | A1 * | 9/2008 | Genihovich | F41H 5/0485 | 89/36.02 |
| 2009/0229453 | A1 * | 9/2009 | Dickson | F41H 5/0414 | 89/36.02 |
| 2012/0180631 | A1 * | 7/2012 | Sporn | F41H 5/0485 | 264/258 |
| 2014/0150635 | A1 * | 6/2014 | Sporn | F41H 5/0464 | 264/258 |
| 2016/0223295 | A1 * | 8/2016 | Tepper | B21D 5/02 | |
| 2017/0059281 | A1 * | 3/2017 | Smith | F41H 1/02 | |
| 2021/0046359 | A1 * | 2/2021 | McCarthy | A63B 31/11 | |

* cited by examiner

MULTI-CURVE STEEL BODY ARMOR AND METHOD OF MANUFACTURING SAME

CROSS REFERENCE TO RELATED APPLICATIONS

This application is a divisional of U.S. patent application Ser. No. 16/025,522, filed on Jul. 2, 2018, now U.S. Pat. No. 11,112,219, issuing Sep. 7, 2021, which is a divisional of U.S. patent application Ser. No. 15/013,906, filed on Feb. 2, 2016, now U.S. Pat. No. 10,030,942, issued on Jul. 24, 2018, which claims the benefit of and priority to U.S. Provisional Application No. 62/110,911, filed on Feb. 2, 2015, the disclosures of which are incorporated herein in their entirety.

TECHNICAL FIELD

The present invention relates to body armor, and more particularly, to body armor constructed of steel.

BACKGROUND

Conventional body armor is available in a number of different configurations and materials. For example, conventional, standard issue armor in use by the U.S. military is constructed of a ceramic such as boron carbide. Other conventional materials used to fabricate body armor include ultra high molecular weight polyethylene (UHMWPE), and aramid fibers. While these various materials have various advantages, ceramic armor, which is typically the conventional choice for defeating rifle rounds, has certain disadvantages. For example, ceramic armor plates can typically only survive a limited number of hits before they break apart and become ineffective. Additionally, ceramic armor is relatively fragile, requiring specialized storage and handling procedures. Ceramic armor is thick, often having more than one inch of thickness. Finally, ceramic armor is expensive, which often puts it outside of the budget range of civilians, police, or security agencies with limited budgets.

Steel has long been used in applications requiring ballistic resistance, such as in armor applications. In particular high hardness abrasion resistant steel, for example, AR500 steel ("abrasive resistant steel; 500 Brinell hardness") has long been used to build bullet traps, shooting targets and as armor plate for vehicles and fixed installations. More recently, AR500, AR550 and AR650 steel has been used to construct body armor. While steel armor is inexpensive and has excellent ballistic resistance, multi-hit capability, and durability, it is heavy and difficult to form. As a result, steel armor plates have typically been offered as flat flats, or at best, single curved plates in which the trauma plate has a curve that is defined about an axis that runs vertically with respect to the torso when the plate is worn. An example of such a single curve steel plate is provided in U.S. Pat. No. 9,021,612. What is needed is a steel armor plate that more naturally matches the contours of the human torso.

SUMMARY OF THE INVENTION

The invention relates generally to a steel body armor plate which is curved along multiple axes at least two of which are mutually orthogonal such that the plate is curved about the long axis of the torso of the wearer, as well as least one axis that is orthogonal to the long axis of the torso. Additionally, embodiments of the invention are directed to methods of imparting curves to a hardened steel plate (e.g., AR500, AR550, or AR650) along multiple axes to allow the plate to more naturally conform to the shape of the human torso, in a rapid, inexpensive and low-temperature process.

The Applicant's disclosure relates generally to a multi-curved armor plate and a method of imparting curves to an abrasion resistant steel armor plate along multiple axes to allow the plate to more naturally conform to the shape of the human torso. Further, the Applicant's disclosure includes a ram-and-die arrangement for imparting curves to the abrasion resistant steel armor plate.

In certain embodiments, the multi-curved armor plate is made from ballistic resistant steel and comprises a convex front surface and a concave rear surface. The armor plate further comprises a first end, an opposing second end, a length, a width, a first axis symmetrically disposed along said length, a second axis disposed along said width, a third axis disposed along said width, a trapezoidal portion at said first end, and in combination with an integral rectangular portion extending to said opposing second end.

In further embodiments, the armor plate comprises a first radius of curvature along said first axis, a second radius of curvature along a second axis adjacent said first end, and a third radius of curvature along a third axis adjacent said second end.

Another embodiment illustrates that the ballistic resistant metal has a Brinell hardness of between about 400 and about 600, preferably between about 505 and 515. In yet further embodiments, at least the front surface of the armor plate comprises a spalling resistant coating, which is polyurea elastomer based. Other embodiments are directed to other types of steel, for example, steels having a Brinell hardness of between about 545 and 560 and between about 570 and 670.

In certain embodiments, a method of manufacturing a steel armor plate comprises providing a plate, which is formed from ballistic resistant steel; bending the armor plate to form a cylindrically curved plate longitudinally; and further bending the armor plate to form one radius of curvature widthwise adjacent to one end and another radius of curvature widthwise adjacent to the opposite end.

The shape of the armor plate is further contoured to fit to the shape of the human torso. Two corners from one end of the armor plate are cut to form a trapezoidal portion in combination with an integral rectangular portion extending to the opposite end of the plate. Further, one of the latitudinal radius of curvature is disposed at the long side of the trapezoidal portion.

The method further comprises providing a die and a ram both with a radius of curvature that, during a pressing process, preserves the radius of curvature along the longitudinal axis; placing the plate over the die; and pressing the plate into the die by the ram.

Additionally, the method further comprises coating the plate with a layer of spalling resistant polyurea elastomer based material.

Embodiments of the invention have certain advantages. Steel body armor according to the invention is resistant to penetration from high-velocity rifle rounds, is durable and has multi-hit capability. Additionally, steel body armor according to the invention resists bullet splash or spalling. Additionally, steel body armor according to the invention can withstand rough handling and sub-optimal environmental and storage conditions. A steel body armor plate according to the invention is highly ergonomic, with a first curve that wraps around the torso about the torso's long axis, a second curve that wraps the plate around the top of the chest, which minimizes interference with the chin, and a third curve that wraps the plate around the bottom of the rib cage.

The resulting triple-curved plate hugs the rib cage area, resulting in coverage of vital organs and vasculature while hugging the contours of the body.

Methods of fabricating armor plates according to embodiments of the invention have additional advantages. Conventional ceramic body armor plates may be formed into relatively complex shapes by hot pressing boron carbide powder into a die under high temperature, or alternatively, by sintering boron carbide powder. These processes cannot be used for form ballistic resistant steel because heating hardened, abrasion resistant steels like AR500, AR550 and AR650 risks annealing the material, which decreases it hardness and therefore decreases its ballistic resistance. Additionally hot pressing and sintering processes are expensive and time consuming, which eliminates one advantage of steel body armor. In contrast, embodiments of the current invention take preformed plates having a first curve along a first long axis, and use the ram-and-die arrangement to impart a second and a third orthogonal curves, in a low temperature process that does not modify the material properties of the steel.

In certain embodiments, the ram-and-die arrangement comprises a die, which comprises two end plates each having a concave edge with a radius of curvature and a plurality of interior support plates between the two end plates, a ram having a convex curved edge, and a stopper disposed adjacent to one of the end plates. Further, each of the support plates has a center height, where the center heights of the support plates are in a step-down, step-up fashion with respect to the center heights of the two end plates. Moreover, the ram, die, and stopper are arranged such that a curved armor plate's convex front side is supported by the concave edges of the two end plates and is positioned such that a predetermined location on the armor plate is below the convex edge of the ram when the armor plate is placed over the die and against the stopper. The ram-and-die arrangement according to an embodiment of the invention is designed to preserve the first long axis curve in the plate while the second and third transverse curves are imparted in a rapid process.

Additional advantages will become clear upon review of the following detailed description of the preferred embodiments.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Figure 1:
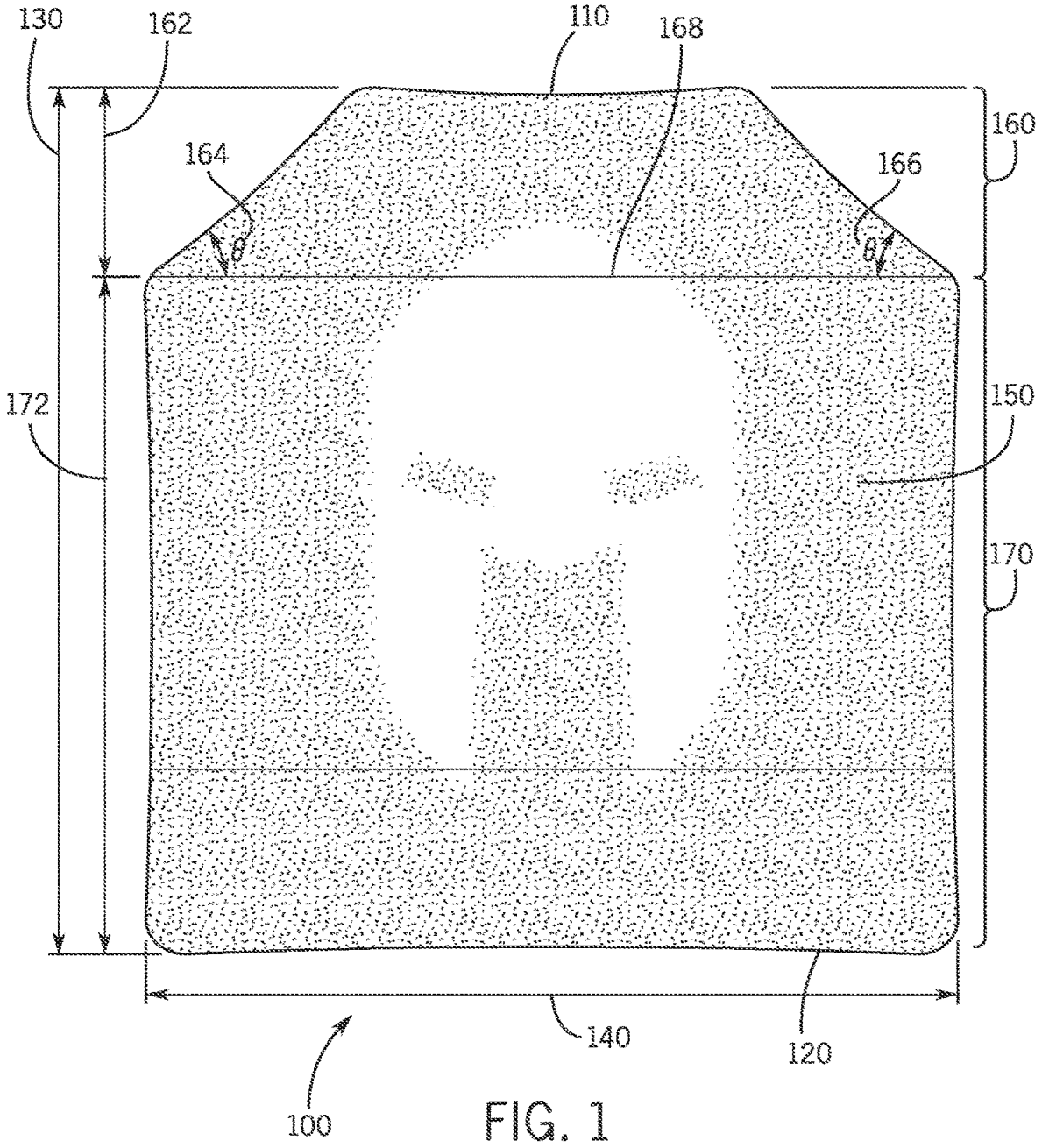
FIG. 1 is a front view of a triple-curved armor plate.

References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention.

In addition, the following disclosure may describe features of the invention with reference to corresponding drawings, in which like numbers represent the same or similar elements wherever possible. In the drawings, the depicted structural elements are generally not to scale, and certain components are enlarged relative to the other components for purposes of emphasis and understanding. It is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed.

The invention as recited in claims appended to this disclosure is intended to be assessed in light of the disclosure as a whole.

In accordance with preferred embodiments of the present invention, methods and apparatus are disclosed for forming a hardened steel trauma plate such that it comprises at least three curves so that it more naturally conforms to the shape of the human torso.

Figure 2:
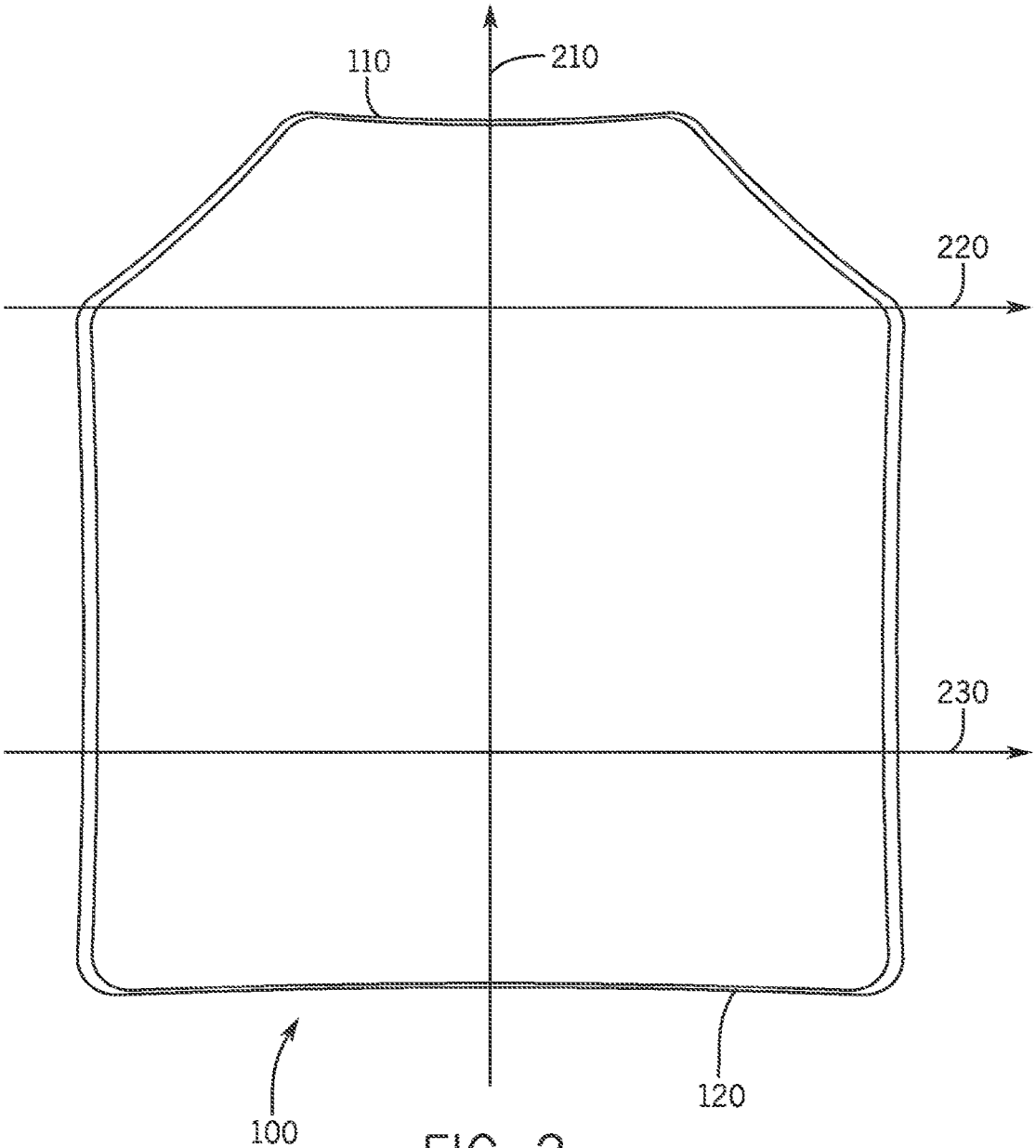
FIG. 2 is a view of the back side of a triple-curved armor plate.

FIG. 1 is a front view of a triple-curved armor plate 100 and FIG. 2 is a rear view of the armor plate 100 according to certain embodiments of the Applicant's disclosure. The triple-curved armor plate 100 can be sized in one of many typical sizes. Exemplary plates measure approximately 8×10", 10×12", and 11×14", but other sizes are acceptable and within the scope of the invention.

In the embodiment of FIGS. 1-4, the triple-curved armor plate 100 comprises a convex front surface 150 (i.e., the strike face) (FIG. 1) and a concave rear surface 240 (FIG. 2). The front surface is where bullets or other projectiles impact and the rear surface faces a user's torso. The triple-curved armor plate 100 further comprises a first end 110, a second opposing end 120, a length 130, and a width 140. When the user wears the triple-curved armor plate and stands upright, length 130 of the armor plate becomes vertical and width 140 of the armor plate becomes horizontal. Moreover, first end 110 of the armor plate, which is disposed underneath the user's collar bone and preferably just below the sternum's manubrium portion, is above second opposing end 120, which is disposed around the user's lower abdominal area, at or above the user's waist.

In certain embodiments, the armor plate 100 has a faceted tombstone shape (i.e., a rectangle with cut or rounded corners) including shoulder cutouts at the end 110 of the armor plate 100. In the embodiment of FIGS. 1-4, the lower corners of the plate at opposing end 120 are rounded, however in other embodiments, the lower corners of the plate at opposing end 120 are defined by flat cuts similar to the shoulder cutouts at 110, but smaller in size. In certain embodiments, the shoulder cuts at end 110 measure about 2.75" and are cut at nominally 45 degrees, but this is not a requirement. In certain embodiments, these shoulder cuts are concave out for further comfort. In certain unillustrated embodiments, the shoulder cuts are asymmetrical, which a first angle, for example the angle of the right cut 164 being greater than 45 degrees, which has the effect of creating a longer cut on the user's right hand side resulting in a narrower profile on the user's right hand side. Such a cut might be advantageous to, for example, allow a right handed shooter to shoulder a weapon more effectively (i.e., to allow a right-handed shooter to place the buttstock of a weapon into his or her shoulder pocket, rather than having to rest the buttstock on the surface of the plate).

More specifically, in certain embodiments, the triple-curved armor plate 100 comprises a trapezoidal portion 160, which includes first end 110 as a shorter base, and an integral rectangular portion 170 extending to opposing second end 120. Further, in some embodiments, the trapezoidal portion 160 is an isosceles trapezoid having two base angles 164 and 166 that are equal in measure. Moreover, in some embodiments, altitude 162, which is the distance at right angle from one base, to the other base of the trapezoidal portion 160, is between about ⅓ to ½ of a length 172 of the rectangular portion 170. As described herein, "about" is used to capture the inherent measure errors. In other embodiments, altitude 162 of trapezoidal portion 160 is about equal to length 172 in measure to ensure better arm and shoulder movements and comfort when a user wears the triple-curved armor plate.

Figure 3A:
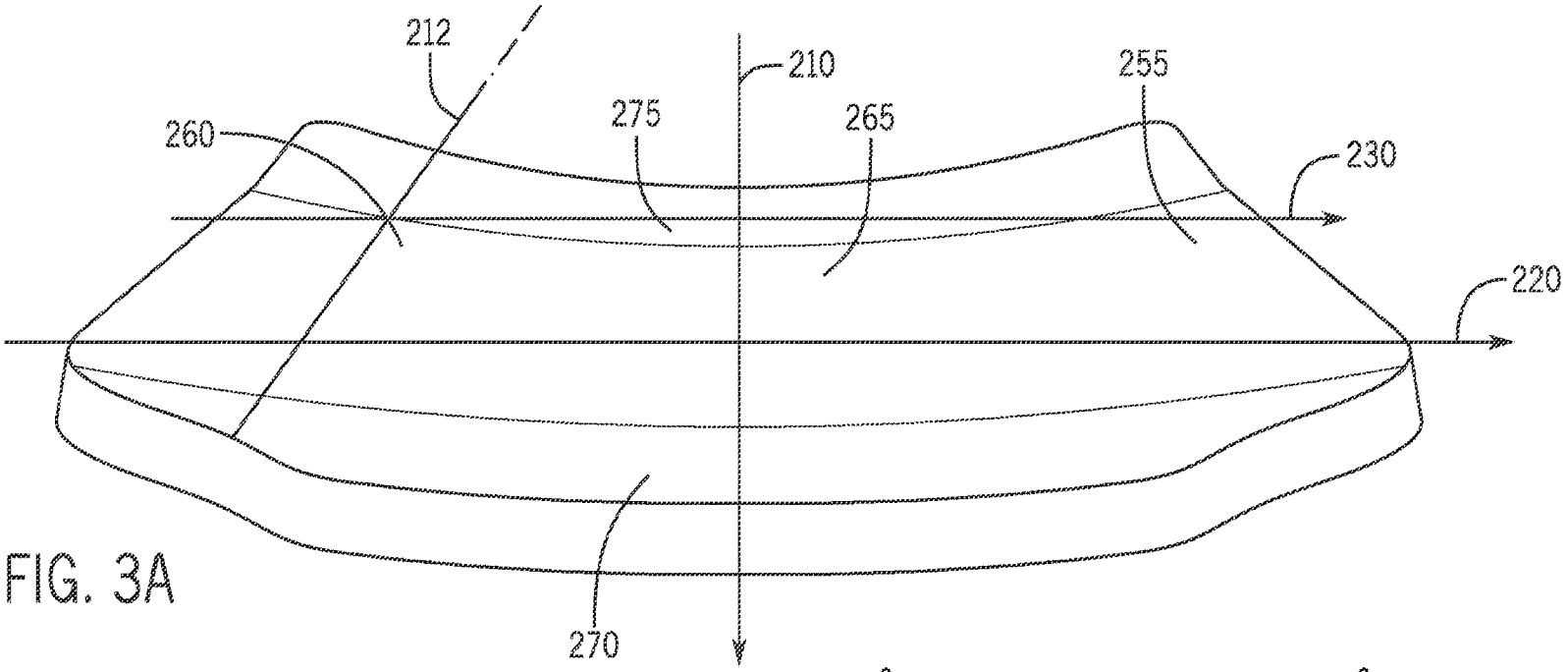
FIG. 3A is an elevated oblique view of a triple-curved armor plate.
Figure 4:
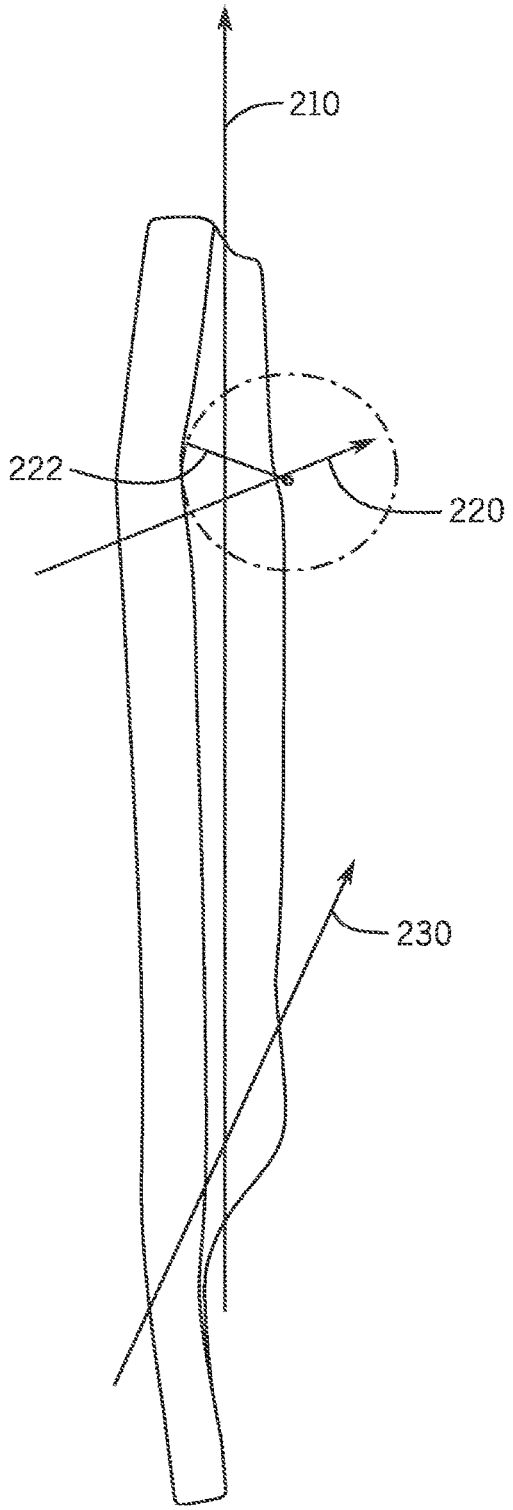
FIG. 4 is a slightly elevated oblique view of a triple-curved armor plate.

Referring now to FIGS. 3A and 4, triple-curved armor plate 100 has a first axis 210, symmetrically disposed along length 130; a second axis 220, disposed along width 140 and adjacent to first end 110; and a third axis 230, which is also disposed along width 140 and adjacent to opposing end 120.

Referring to FIG. 3A, the armor plate 100 comprises a first radius of curvature 212 about first axis 210. In certain embodiments, first axis 210 becomes vertical when a user wears the armor plate 100 and stands upright.

Figure 3B:
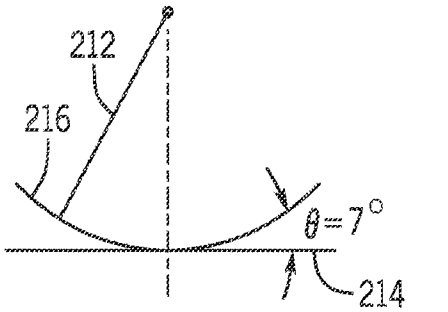
FIG. 3B illustrates the angle formed between a curvature defined by the first radius of curvature along the first axis and the tangent line at a center point of the curvature.
Figure 3C:
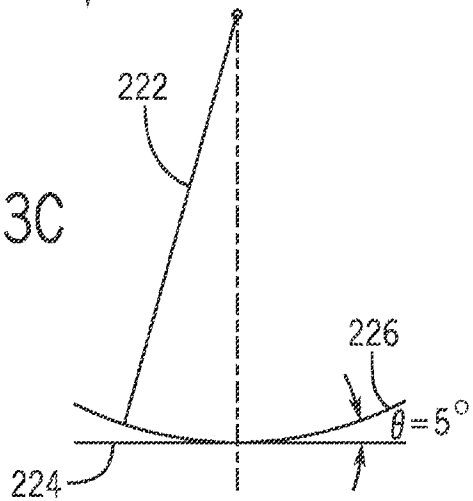
FIG. 3C shows the angle formed between a curvature defined by the second radius of curvature along the second axis and the tangent line at a center point of the curvature.
Figure 3D:
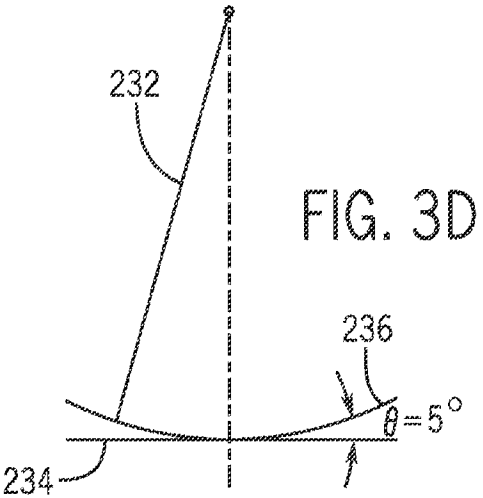
FIG. 3D illustrates the angle formed between a curvature defined by the third radius of curvature along the third axis and the tangent line at a center point of the curvature.

Referring to FIG. 3B, in certain embodiments, a curvature 216 defined by radius of curvature 212 creates about a 7 degree angle of the left and right lateral portions 255, 260, with respect to a tangent line 214 at a center point of the armor plate 100 In other words, if the concave curvature of the rear surface 240 of plate 100 is approximated with planar segments, with an approximate center planar segment 265 at the center or vertex of rear surface 240, left and right lateral portions 255, 260 each are angled back at about 7 degrees with respect to center planar segment. As a result of bending the armor plate 100 along first axis 210 to form radius of curvature 212, the armor plate 100 further comprises a convex front surface 150 and a concave rear surface 240. The curvature of the armor plate 100 defined by radius of curvature 212 allows the armor plate 100 to arch toward a user's torso and to hug a torso better than a flat armor plate.

In the embodiment of FIGS. 1-4 a second axis 220 is disposed along side the longer base 168 (FIG. 1) of the trapezoidal portion 160. A bend having a second radius of curvature 222 is formed in the plate about the second axis 220, and results in a bend in the plate in the vicinity of the longer base 168 of the trapezoidal portion 160. The bend in the armor plate 100 about the second radius of curvature 222 allows armor plate 100 to arch toward a user's body above the pectoral muscles when the user wears the armor plate. A bend having a third radius of curvature 232 is formed in plate 100 about the third axis 230 adjacent to opposing second end 120. Third axis 230 is formed in between the bottom ¼th and ⅓rd of rectangular portion 170 of the plate. The bend about third axis 230 allows armor plate 100 to arch toward a user's body below the ribcage when the user wears the armor plate.

The bends about second 220 and third 230 axes create angled upper 270 and lower 275 portions of plate 100. The angle of these upper and lower 270, 275 portions make with approximate central planar portion 265 is approximately 5 degrees, measured along the vertical centerline of plate 110, i.e., along a projection of axis 210. Off of the projection of axis 210, the bends about axes 220, 230 interact with the vertical bend about axis 210 to create a compound angle in angled upper 270 and angled lower 275 portions with respect to approximate planar center portion 265.

In the embodiment of FIGS. 1-4, second axis 220 is orthogonal to first axis 210 and third axis 230 is also orthogonal to first axis 210. Further, second axis 220 is parallel to third axis 230.

In certain embodiments, first radius of curvature 212 is greater than second radius of curvature 222 or third radius of curvature 232. Further, second radius of curvature 222 substantially equals to third radius of curvature 232. As described herein, "substantially" means that the two radii of curvature differ from each other within 5% of the length of the radius. More specifically, a curvature defined by second radius of curvature 222 substantially matches another curvature defined by third radius of curvature 232.

In certain embodiments, a curvature defined by radius of curvature 222 or 232 forms about a 5 degree angle with respect to a tangent line 224 (FIG. 3C) or a tangent line 234 (FIG. 3D) at a center point of the curvature.

In embodiments where plate 100 is an 8×10" plate, the top and bottom bends along axes 220 and 230 are placed about 2.5" from the top and bottom edges 110, 120 of plate 100. For 10×12" and 10×14", the top and bottom bends are placed about 3.25" from the top and bottom edges of the plate 100.

In certain embodiments, armor plate 100 is formed from AR500 steel, which has a thickness of about 0.25", but armor plate 100 can also be formed from any other ballistic resistant steel in any thickness capable of defeating a designed for threat. As described herein, "about" is used to capture the internal measure errors. In certain embodiments, ballistic resistant steel having Brinell hardnesses of between about 400 and about 600 is acceptable depending on the application. In certain embodiments, the AR500 steel has a Brinell hardness of between about 495 and about 515, and particularly between about 505 and about 515 is preferred. In other embodiments, plate 100 is formed of AR550 steel having a Brinell hardness of between 545 and 560. In yet other embodiments, plate 100 is formed of AR650 steel having a Brinell hardness of between 570 and 670. In embodiments using AR550 steel, the thickness of the steel portion of plate 100 is again about 0.25". In embodiments using AR650 steel, which allows for a reduced steel thicknesses to be used, plate 100 has a thickness of about 3/16".

In the embodiment of FIGS. 1-4, in order to prevent spalling or bullet splash, that is, in order to catch bullet fragments once the armor plate has intercepted and shattered the bullet, armor plate 100 includes a polyurea elastomer based coating on at least front surface 150 and preferably on rear surface 240 as well. In certain embodiments, the polyurea elastomer based coating comprises a thickness of about 0.25" on the front side 150 of plate 100, and is put on the concave back side of plate 100 in a reduced thickness, for example, for aesthetic or rust mitigation purposes. A polyurea is formed when isocyanates react with synthetic resin blend components. In certain embodiments, the isocyanate can be aromatic, aliphatic, monomer, polymer, quasi-prepolymer, or prepolymer. In certain embodiments, the resin blend can be amine-terminated polymer resins and/or amine-terminated chain extenders. The resin blend can also contain additives or other non-primary components, such as, adhesion promoters—an epoxy silane and an amino silane. An exemplary acceptable coating for spall mitigation is PAXCON® PX-2100 available from the Line-X® Corporation of Huntsville, Ala., but other polyurea coatings are acceptable, such as TuffGrip® lining available from Rhino Linings Corporation of San Diego, Calif.

Figure 5:
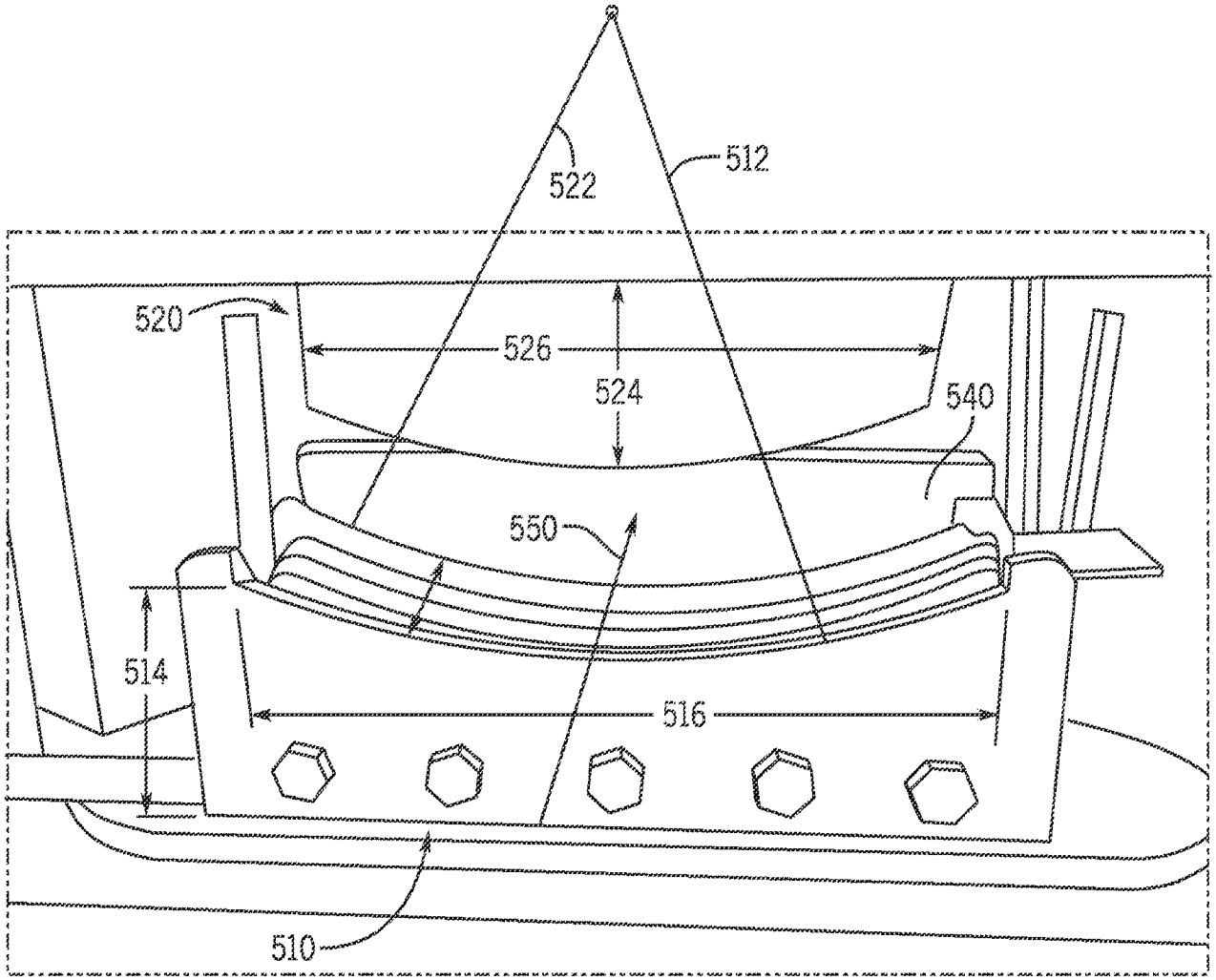
FIG. 5 shows a ram-and-die arrangement usable to fabricate a triple-curved armor plate.
Figure 6:
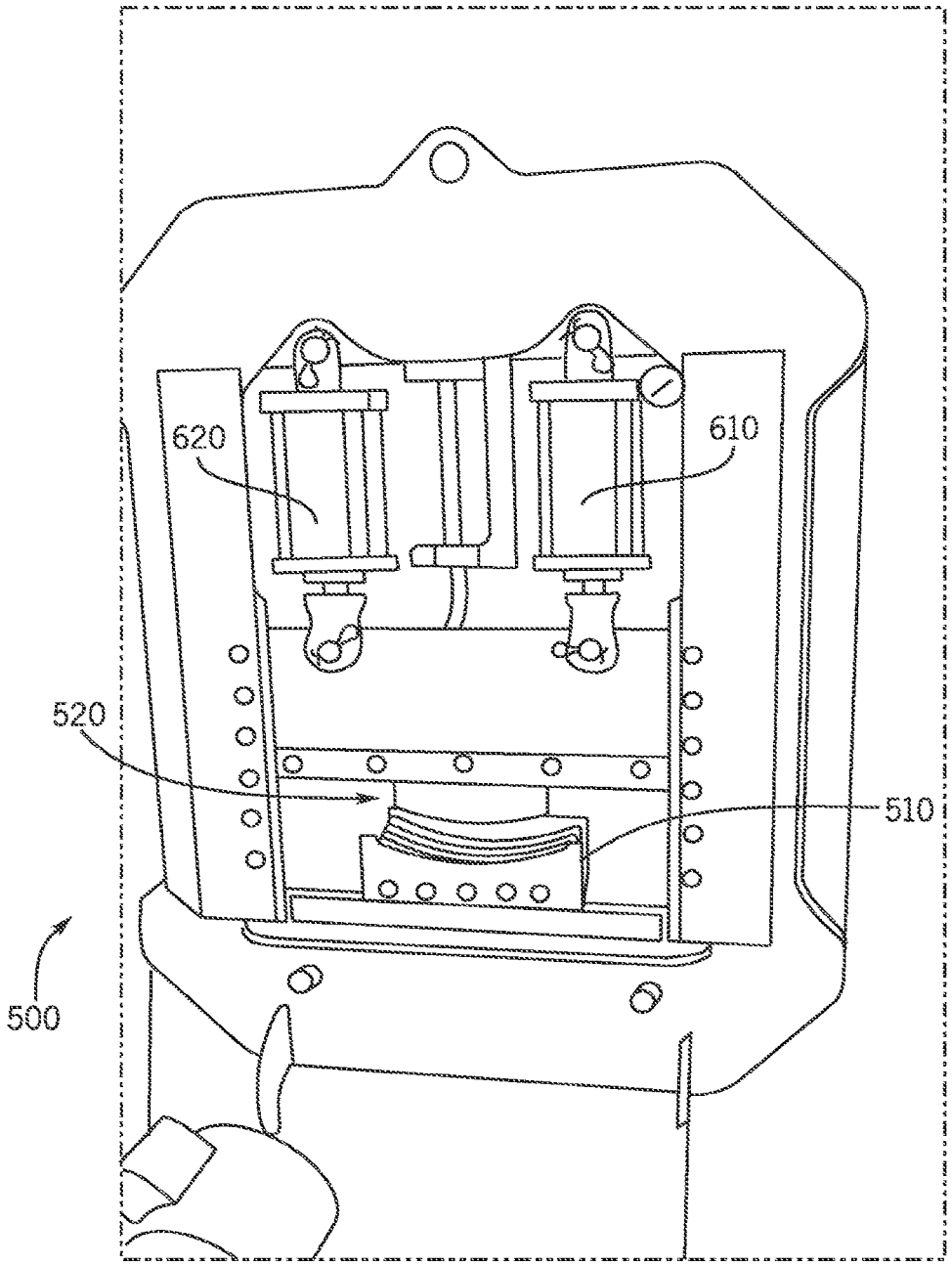
FIG. 6 is another view of the ram-and-die arrangement used to fabricate triple-curved armor plates.

FIGS. 5 and 6 illustrate a ram-and-die arrangement 500 used to fabricate an armor steel plate 100. In the embodiment of FIGS. 5 and 6, a die 510, includes a plurality of plates each having a curved edge arranged, in the view of FIG. 5 to be concave up. The curved edge of each plate has a radius of 512 that substantially equals to first radius of curvature 212 of an armor plate 100 fabricated according to the invention. More specifically, die 510's curvature defined by radius of curvature 512 substantially matches armor plate 100's curvature defined by first radius of curvature 212. As will be explained further below in reference to FIG. 7, the curvature of the interior plates is not critical and should not be considered limiting, as it is not necessary that these curves match radius 512 of the end plates, or plate radius 212. In total, the plate stack of die 510 has a thickness of about 4.25". Moreover, the end plates of die 510 have a height 514 and a width 516, wherein width 516 is greater than height 514. In the embodiment of FIGS. 5 and 6, the end plates of die 510 measure about 3.5" by 13.5".

In the embodiment of FIGS. 5 and 6 the series of metal plates is offset in a down-then-up and stepwise fashion so that, collectively, the top edges of the metal plates that make up the sheet stack define die 510's curvature. In certain embodiments, there are 7 curved metal plates in the metal plate stack arranged in a step-down-then-up sequential manner, the 7 plates being sandwiched between a front and back endplate. The endplates have a thickness of about 3/8", while the interior plates have a thickness of about 0.5". In alternative embodiments, the thickness of die 510 can be adjusted by adding or removing metal plates. In the embodiment of FIGS. 5-6, the radius of the curve of the endplates 512, and the radius of the vertical bend of armor plate 100 to be formed with the tooling of the embodiment is about 15.5". In alternative embodiments, die 510 comprises an integral block of metal having front and back curved, concave up portions each having a radius of curvature 512, with a recessed interior portion also having a radius of curvature that is concave up.

The embodiment of FIGS. 5 and 6 also include a ram 520 that has convex curved edge having a radius of curvature 522 that substantially equals to first radius of curvature 212, and die radius 512. Further, ram 520's curvature defined by radius of curvature 522 substantially matches armor plate 100's curvature defined by first radius of curvature 212. Ram 520 is convex and corresponds to concave die 510. Moreover, ram 520 comprises a height 524 and a width 526, wherein width 526 is greater than height 524. In one embodiment the width 526 of ram 520 is about 10".

In the embodiment of FIGS. 5 and 6, ram 520 is powered by hydraulic cylinders 610 and 620. Hydraulic cylinders 610 and 620 are actuated by the pressure from a fluid pump, which can be driven by an electric motor. In other embodiments, ram 520 is powered electronically or mechanically.

Figure 7:
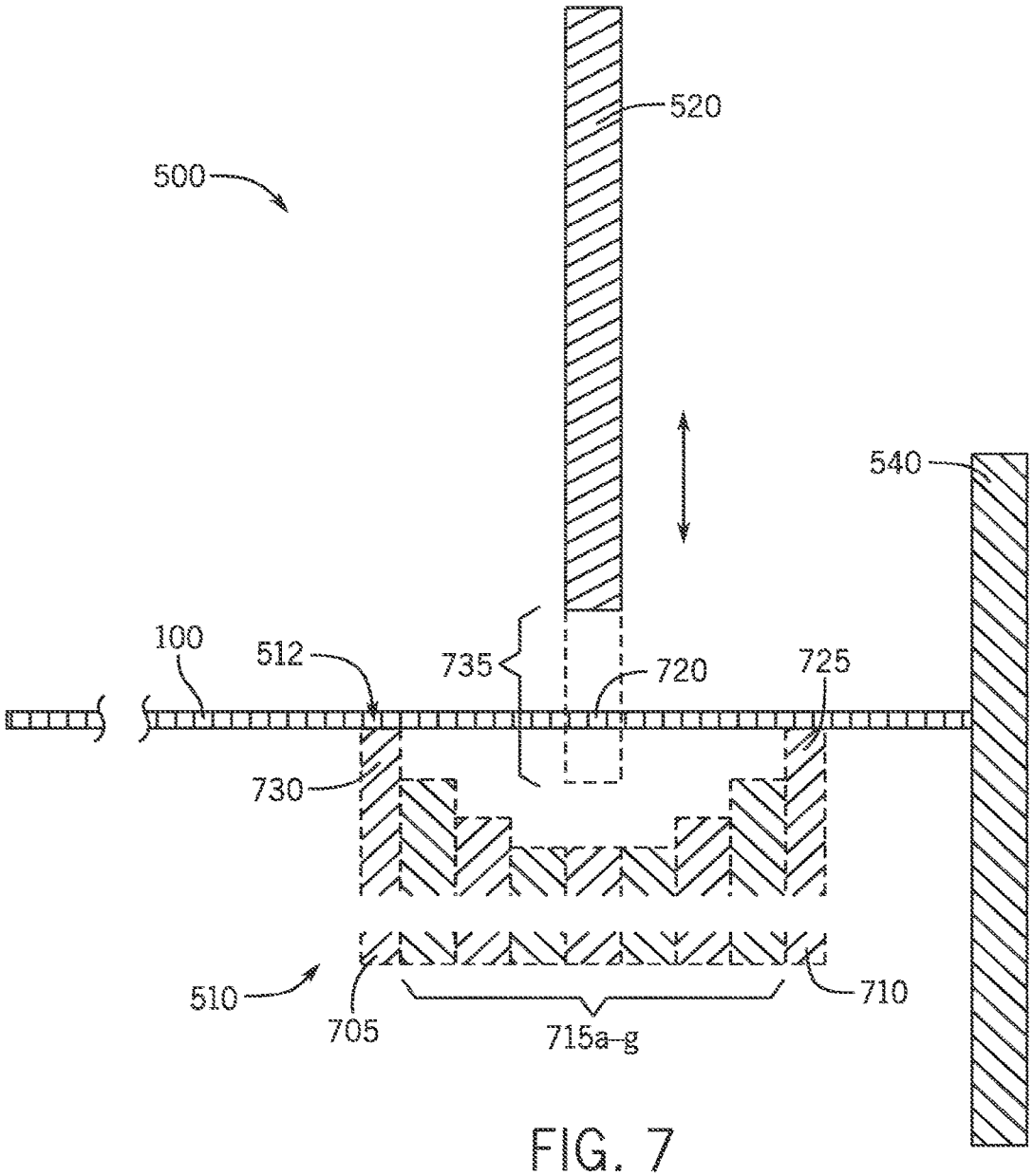
FIG. 7 is a cross section through the centerline of the arrangement of FIG. 6, including an armor plate to be formed.

FIG. 7 shows a cross section of the arrangement of FIGS. 5-6 along a section line running down the middle of die 510 starting from the approximate position of the central fastener illustrated in FIG. 5. As can be seen in FIG. 7, a die 510 is provided that includes a first end plate 705 and a second end plate 710. Each of these endplates has a concave, upward facing curved edge having a radius of curvature 512. Between endplates 705, 710 are a plurality of support plates 715*a-g*. In the example of FIG. 7 there are 7 interior plates, but the number is not critical. In the embodiment of FIG. 7, end plates 705 and 710 have a first height (i.e., along the pictured cross section), adjacent support plates 715*a-g* have a second height less than the first height, support plates 715*b,f* have a third height that is less than the second height, and support plates 715*c-e* have a fourth height that is less than the third height. This arrangement creates a step-down, step-up height variance along the cross section, as shown. In one particular embodiment, the first height is about 2.3", the second height is about 1.8", the third height is about 1.6" and the fourth height is about 1.3". The effect is to approximate a concave up curve along the direction of the cross section, as shown. Each of the support plates 715*a-g* also has a concave up curved edge that has a radius of curvature equal to the vertical bend of plate 100 (i.e., radius 512, 212, etc.). One advantage of this step-down, step-up arrangement of curved plates is to provide clearance for the deflection of plate 100 as it is being bent by ram 520 as ram 520 moves through its pictured range of vertical motion. Also included in the arrangement of FIG. 7 is stopper 540 and armor plate 100.

A method of manufacturing a triple-curved armor plate 100 using ram-and-die arrangement 500 pictured in FIGS. 5-7 will now be described. A planar member formed from ballistic resistant metal of appropriate thickness is provided, for example, a 4×8' sheet of 0.25" AR500 or AR550 steel or 3/16" AR650 steel. Armor plate blanks are cut from the sheet of steel, for example, by a plasma or laser cutting process. Ideally, the armor plate blanks are cut from the planar sheet steel member without significantly raising the temperature of the steel. When blanks are plasma cut, a water bath may be used to mitigate the attendant local temperature increase. The cut armor blanks have the desired dimensions for finished armor plates, for example, the dimensions are 8×10", 10×12", 11×14", etc. Further, the blanks are shaped into faceted tombstone shapes as described herein, having rounded corners, shoulder cuts, etc. The armor blanks are then bent about an axis running parallel to their long dimension and along the vertical centerline of the blank (i.e., axis 210) such that the plate has a radius of curvature 212 about axis 210. In certain embodiments, this first curve is imparted after the blanks are diced from sheet steel, but this is not a requirement. In certain embodiments, the planar members are bent to form first radius of curvature 212 along first axis 210 prior to being shaped into faceted tombstone shapes. In further embodiments, the planar members are shaped into faceted tombstone shapes prior to being bent to form first radius of curvature 212 along first axis 210.

The curved plate with first radius of curvature 212 is placed over die 510 one end at a time with concave back surface facing up toward ram 520 and the convex front surface engaged and supported by the curved surfaces of endplates 705, 710, which have the same radius of curvature 212. The end of curved plate 100 is engaged by a metal stopper 540 (FIGS. 5 and 7), thus, the curved plate cannot be inserted further along the horizontal direction when one end of the curved plate is placed over die 510. The distance between metal stopper 540 and die 510 is adjustable to accommodate different positions described herein where second and third bends having radii of curvature 222 and 232 are to be formed on armor plate 100, as well as to accommodate different sizes of plate 100. In one embodiment, for 10×12" plates, the distance from stopper 540 to the edge of the proximate endplate 710 is about 1.25".

A first end, for example, end 110 of the curved plate 100 with first radius of curvature 212 is inserted into die 510 and ram 520 presses down on the curved plate to form second radius of curvature 222 along second axis 220 at longer base 168 of trapezoidal portion 160 (FIG. 1). The second radius 222 of this first transverse bend created by this process is determined by the distances between the contact point of ram 520 on plate 100 (720) and each of the points 725, 730 on the plate 100 where it is supported by the front and back endplates 705, 710, as well as the plunge distance 735 of ram 520. The position of the bend of the second radius 222 is determined by the distance between the stopper 540 and the contact point of ram 520 on plate 100 (720), which is to say that the location of the bend of the second radius 222 occurs at the contact point of the ram 520.

Both the radius of the transverse bend and the position of the transverse bend are adjustable by varying the position of the stopper 540, the lateral position of the ram 520 with respect to end plates 705, 710, the plunge distance 720 and the number of support plates 715*a-g* between the end plates. In the embodiment of FIGS. 5-7, the ram 520 is laterally positioned to be symmetrically between end plates 705, 710, but this is not a requirement. Laterally offsetting ram 520 with respect to end plates 705, 710 may be useful to create an asymmetrical transverse bend, i.e., a bend that changes its radius of curvature throughout the bend.

After the first transverse bend of radius 222 is imparted, the ram returns to its up position, and plate 100 is reversed and the process is repeated. The opposing second end 120 of the curved plate is inserted into die 510 and ram 520 presses down on the curved plate to form third radius of curvature 232 along third axis 230 between bottom ¼th and ⅓rd of rectangular portion 170 (FIG. 1). The method is not limited to a certain order of which end is inserted into die 510 first. In certain embodiments, end 110 is inserted into die 510 before opposing second end 120. In further embodiments, opposing second end 120 is inserted into die 510 before first end 110.

During each of the transverse bending steps described above, the down facing convex surface of plate 100 is supported by the concave up facing curved edges of endplates 705 and 710 of die 510. In one embodiment, the curvature of the concave upward facing edges of plates 705, 710 (512) is substantially the same as the curvature 212 of the plate 100, and is the same as the convex curvature of the ram. The effect of this is that the curvature 212 of the bend of the plate along the vertical axis is preserved while the first and second transverse bends are imparted to the plate.

The method further comprises coating the triple-curved armor plate 100 with spalling resistant polyurea elastomer based material. In certain embodiments, the polyurea elastomer coating is applied only to front surface 150. In certain embodiments, the polyurea elastomer coating is applied to both front surface 150 and rear surface 240. In certain embodiments, the polyurea elastomer coating comprises a thickness of about 0.25" on the front surface 150.

In certain embodiments, the polyurea elastomer based coating is applied to the planer member before any of the bending steps. In further embodiments, the polyurea elastomer bases coating is applied after all the bending steps. In yet further embodiments, the polyurea elastomer based coating can be applied after the planar member is bent to form radius of curvature 212 along axis 210.

While the preferred embodiments of the present invention have been illustrated in detail, it should be apparent that modifications and adaptations to those embodiments may occur to one skilled in the art without departing from the scope of the present invention.

What is claimed is:

1. A ram-and-die arrangement for imparting bends to a ballistic resistant armor plate, the arrangement comprising:

a die comprising a first and second end plates each having a concave edge with a first radius of curvature and a plurality of interior support plates between the first and second end plates, each of the interior support plates also having a concave edge with a radius of curvature, each of the support plates having a center height, where the center heights of the support plates are arranged in a step-down, step-up fashion with respect to center heights of the end plates;

a ram having a convex curved edge, and a stopper disposed adjacent to one of the end plates of the die, wherein, the ram, die and stopper are arranged such that a curved armor plate having a convex front side and a concave back side, may be placed over the die and against the stopper such that its convex front side is supported by the concave edges of the first and second end plates, and is positioned such that a predetermined location on the plate is below the convex edge of the ram.

2. The arrangement of claim 1, wherein the radii of curvature of the concave edges of the support plates is the same.

3. The arrangement of claim 2, wherein the radii of curvature of the concave edges of the support plates is the same as the first radius of curvature.

4. The arrangement of claim 1, wherein the first radius of curvature matches a radius of curvature associated with the convex front side of the armor plate.

5. The arrangement of claim 1, wherein the convex edge of the ram has a radius of curvature, which matches the first radius of curvature.

6. The arrangement of claim 1, wherein the predetermined location is coincident with a concave edge of a support plate that is maximally vertically offset with respect to the concave edge of one of the end plates as compared to the other support plates.

7. The arrangement of claim 1, wherein the ram and the stopper are arranged such that, when an armor plate is placed against the stopper, the ram is positioned to contact the armor plate at a location between ¼th and ⅓ along a central axis running the length of an inserted armor plate.

8. The arrangement of claim 1, wherein the center heights of the interior support plates, together, define a symmetrical, concave up shape having a vertex.

9. The arrangement of claim 8, wherein the concave edge of the ram is arranged over the vertex.

10. The arrangement of claim 8, wherein the concave edge of the ram is arranged to be offset from the vertex.

11. The arrangement of claim 1, wherein the center heights of the interior support plates, together, define an asymmetrical, concave up shape.

12. A method of fabricating an armor plate, the method comprising:

providing a die comprising a first and second end plates each having a concave edge with a first radius of curvature and a plurality of interior support plates between the first and second end plates, each of the interior support plates also having a concave edge with a radius of curvature, each of the support plates having a center height, where the center heights of the support plates are arranged in a step-down, step-up fashion with respect to center heights of the end plates;

providing a ram having a convex curved edge;

placing an armor plate having a convex front side and a concave back side over the die, such that the convex front side is supported by the concave edges of at least one of the first and second end plates; and contacting the armor plate with the ram and bending the armor plate at a position along the armor plate between the first and second end plates.

13. The method of claim 12, wherein the armor plate is supported by one or more of the concave edges of the interior support plates as it is being bent.

14. The method of claim 12, further including providing a stopper disposed adjacent to one of the end plates of the die and placing the armor plate against the stopper.

15. The method of claim 14, wherein, the ram, die, stopper and armor plate are arranged such that when an armor plate is placed against the stopper, the ram is positioned to contact the armor plate at a location between ¼th and ⅓ along a central axis running the length of an inserted armor plate.

16. The method of claim 12, wherein the center heights of the interior support plates, together, define a symmetrical, concave up shape having a vertex.

17. The method of claim 16, wherein the concave edge of the ram is arranged over the vertex.

18. The arrangement of claim 16, wherein the concave edge of the ram is arranged to be offset from the vertex.

19. The arrangement of claim 12, wherein the center heights of the interior support plates, together, define an asymmetrical, concave up shape.

* * * * *